United States Patent [19]

Williams

[11] Patent Number: 5,018,279

[45] Date of Patent: May 28, 1991

[54] STRIP SHINGLE ALIGNMENT TOOL

[76] Inventor: Clarence F. Williams, 1601 E. Iowa Ave., St. Paul, Minn. 55106

[21] Appl. No.: 512,652

[22] Filed: Apr. 20, 1990

Related U.S. Application Data

[63] Continuation-in-part of Ser. No. 309,482, Feb. 13, 1989, abandoned.

[51] Int. Cl.[5] ..... G01D 21/00

[52] U.S. Cl. ..... 33/649; 33/648

[58] Field of Search ..... 33/646, 647, 648, 649

[56] References Cited

U.S. PATENT DOCUMENTS

| | | | |
|---|---|---|---|
| 563,830 | 7/1896 | Pelley | 33/649 |
| 780,697 | 1/1905 | Adams | 33/649 |
| 1,067,121 | 7/1913 | Johnson | 33/649 |
| 1,256,192 | 2/1918 | Aksdal | 33/649 |
| 1,366,462 | 1/1921 | Johnson | 33/649 |
| 1,396,274 | 11/1921 | Neumeister | 33/649 |
| 1,405,760 | 2/1922 | Collins et al. | 33/649 |
| 2,470,183 | 5/1949 | Peters | 33/649 |
| 2,889,632 | 6/1959 | Longhi | 33/648 |
| 2,891,318 | 6/1959 | Harrrison et al. | 33/648 |
| 3,110,113 | 11/1963 | Baker | 33/649 |
| 4,056,889 | 11/1977 | Barnett, III | 33/649 |
| 4,183,144 | 1/1980 | Barnett, III | 33/649 |
| 4,285,134 | 8/1981 | Schmanski | 33/649 |

*Primary Examiner*—Thomas B. Will

*Attorney, Agent, or Firm*—Kinney & Lange

[57] ABSTRACT

An alignment tool for positioning square tab shingles on a roof surface in perfect alignment with shingle strips already fastened to the roof includes a long, straight shingle positioning plate having a base flange and an unfastened shingle positioning flange extending at right angles up away from the base flange. Two clamps extend back from the base flange, each clamp having an upper jaw mounted to the positioning plate and a lower jaw pivoted to the upper jaw. A bottom row positioning stop is located between the jaws of each clamp. The lower jaw of each clamp is slid underneath the bottom edge of a shingle in the top row of fastened shingles until that edge is in contact with the positioning stop. Unfastened shingles are then positioned with their bottom edges against the unfastened shingle positioning flange, the shingles are butted against each other, and then are ready to be nailed or stapled into place.

5 Claims, 5 Drawing Sheets

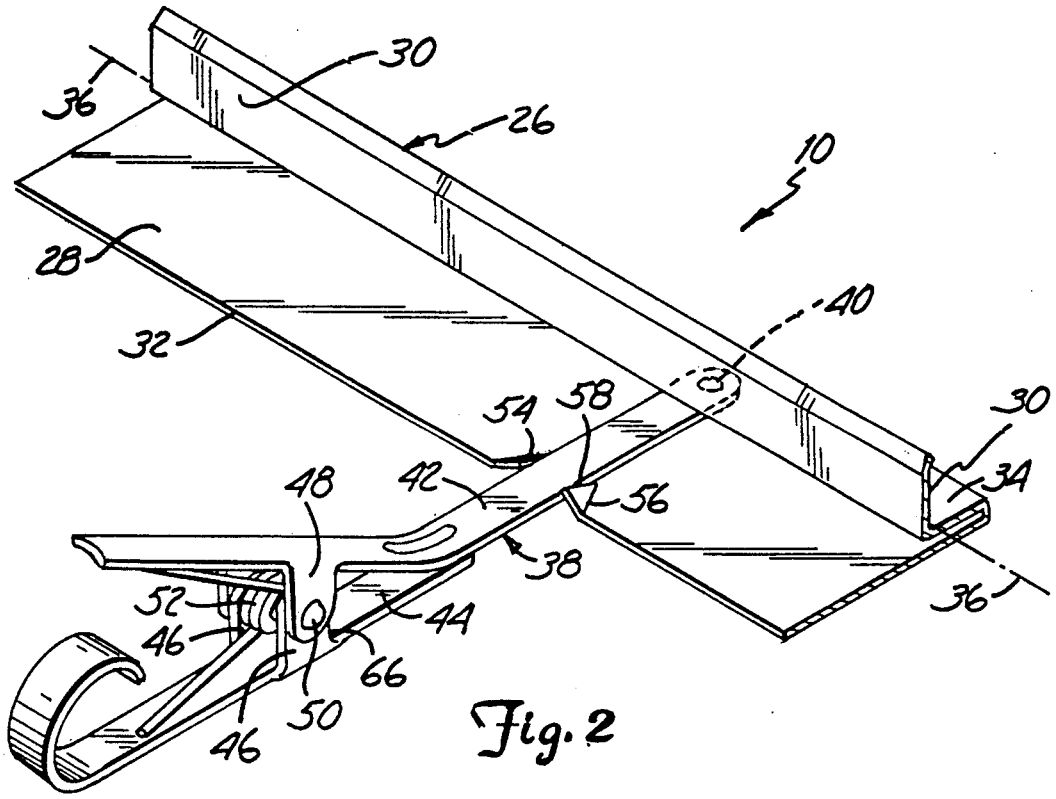
Fig. 2
Fig. 4
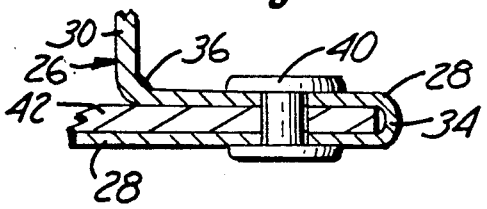
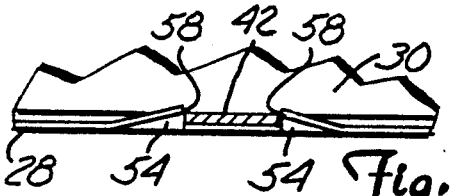
Fig. 5

Fig. 9
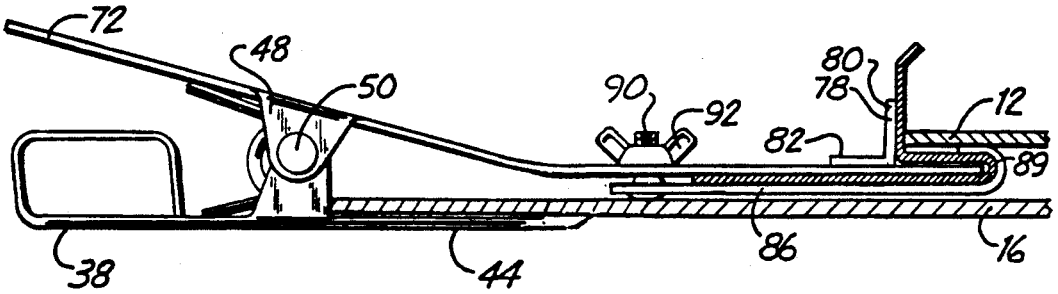
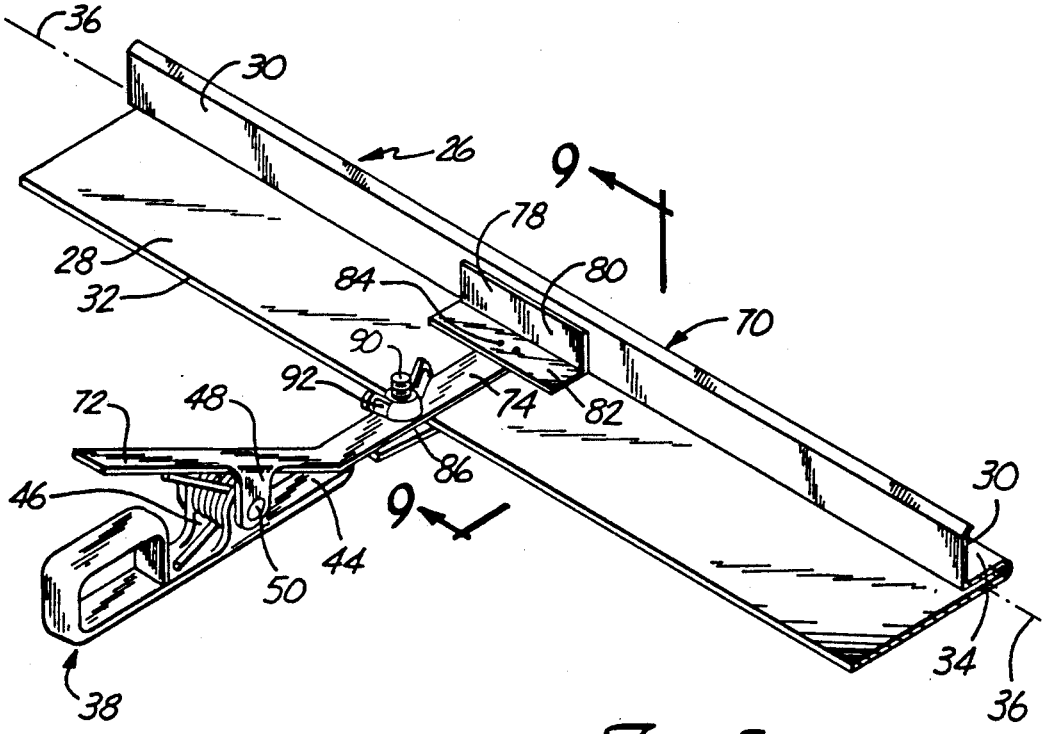
Fig. 7

STRIP SHINGLE ALIGNMENT TOOL

This is a continuation-in-part application of co-pending application Ser. No. 07/309,482, filed Feb. 13, 1989 now abandoned.

BACKGROUND OF THE INVENTION

This invention has relation to tools useful for positioning strip shingles on a roof surface preparatory to permanently fastening those shingles to the roof.

A roof project using square tab strip shingles typically involves affixing to the bottom edge of the roof a roofing starter roll by traditional nailing or stapling methods. Successive rows of square tab shingles are positioned to overlap the starter roll and the shingles of each successive roll are then attached to the roof, also by traditional nailing or stapling methods.

Before the present invention, attempts to obtain precise placement of each successive row of shingles to provide uniform alignment of shingle shadow lines included using chalk line, "naked eye", or notched hammer techniques. Skilled and experienced craftsmen are accustomed to obtaining satisfactory alignment of successive rows of shingle strips and of the strip singles within those rows; but the novice, careless, or "do-it-yourself" worker encounters substantial alignment difficulties while experience is being gained and skill is being acquired.

What was needed before the present invention was an alignment tool which could be fastened to a lower shingle strip to serve as a guide for precisely positioning a number of strip shingles of the next upper row to allow them to be nailed or stapled in the traditional manner.

In the above-identified parent application, the Examiner cited and applied the following U.S. patents as being pertinent:

U.S. Pat. No. 563,830 granted July 1896 to Pelley; U.S. Pat. No. 4,056,889 granted November 1977 to Barnett III; and U.S. Pat. No. 1,405,760 granted February 1922 to Collins and MacCormack.

This Examiner also cited the following U.S. patents as of interest:

U.S. Pat. No. 4,183,144 granted January 1982 to Barnett III;

U.S. Pat. No. 4,285,134 granted August 1981 to Schmanski;

U.S. Pat. No. 2,889,632 granted June 1959 to Longhi;

U.S. Pat. No. 2,891,318 granted June 1959 to Harrison et al.;

U.S. Pat. No. 1,396,274 granted November 1921 to Neumeister; and

U.S. Pat. No. 1,067,121 granted July 1913 to Johnson.

SUMMARY OF THE INVENTION

An alignment tool for positioning strip shingles on a roof with respect to strip shingles of an already fastened shingle strip includes an elongate straight-edge unfastened-shingle positioning plate having a substantially flat, longitudinally extending base flange and a longitudinally extending unfastened-shingle positioning flange extending up from the base flange in normal relation thereto and defining at its connection with the base flange, a straight unfastened-shingle bottom edge positioning line; at least two spaced-apart clamps, each clamp having an elongate upper jaw mounted to the shingle positioning plate and extending rearwardly in the plane of the base flange in normal relation to the bottom edge positioning line. Each clamp has a lower jaw pivoted to the upper jaw and adapted to extend under a bottom edge portion of a shingle in the strip of fastened shingles, and each clamp is manually operable to move the jaws between closed and open positions. Resilient means is provided to tend to maintain the jaws in closed position.

A fastened-shingle bottom edge locating stop is provided between the jaws of each clamp. Each stop is positioned to come into interfering, blocking, relation with a bottom edge of a shingle in the fastened shingle strip when its clamp is not in closed position and the lower jaw is extended to the limit of its movement up under a shingle of the fastened strip.

The distance between the locating stop and the bottom edge positioning line in direction normal to the positioning line is equal to the predetermined desired distance between the bottom edge of the fastened shingle strip and the bottom edge of the shingles to be fastened.

In a first embodiment of the invention, the elongate upper jaw of each of the clamps is pivotally mounted on an upright axis to a forward portion of the base flange of the shingle positioning plate in order that the clamps can be pivoted toward parallel relationship with the longitudinal axis of the positioning plate so as to take up less room when packaged for sale or shipment and/or storage.

In a second embodiment of the invention, the elongate upper jaw of each of the clamps is mountable with respect to the base flange of the shingle positioning plate to lie in normal relationship to the longitudinally extending shingle positioning flange of the base flange. When these clamps are removed, the overal dimensions of the entire unit will require considerably less space when packed for sale or shipment and/or storage.

BRIEF DESCRIPTION OF THE DRAWINGS

FIG. 2 is an enlarged fragmentary perspective view of a portion of the tool of FIG. 1;

FIG. 4 is an enlarged vertical fragmentary sectional view taken on the line 4—4 in FIG. 3;

FIG. 5 is an enlarged fragmentary sectional view taken on the line 5—5 in FIG. 3;

FIG. 7 is a fragmentary perspective view of a strip shingle alignment tool of a second embodiment of the invention;

FIG. 9 is a vertical sectional view of the tool of FIG. 7 taken on the line 9—9 in FIG. 7 and showing its relation to shingles being fastened as also seen in FIG. 6.

DESCRIPTION OF PREFERRED EMBODIMENTS

Figure 1:
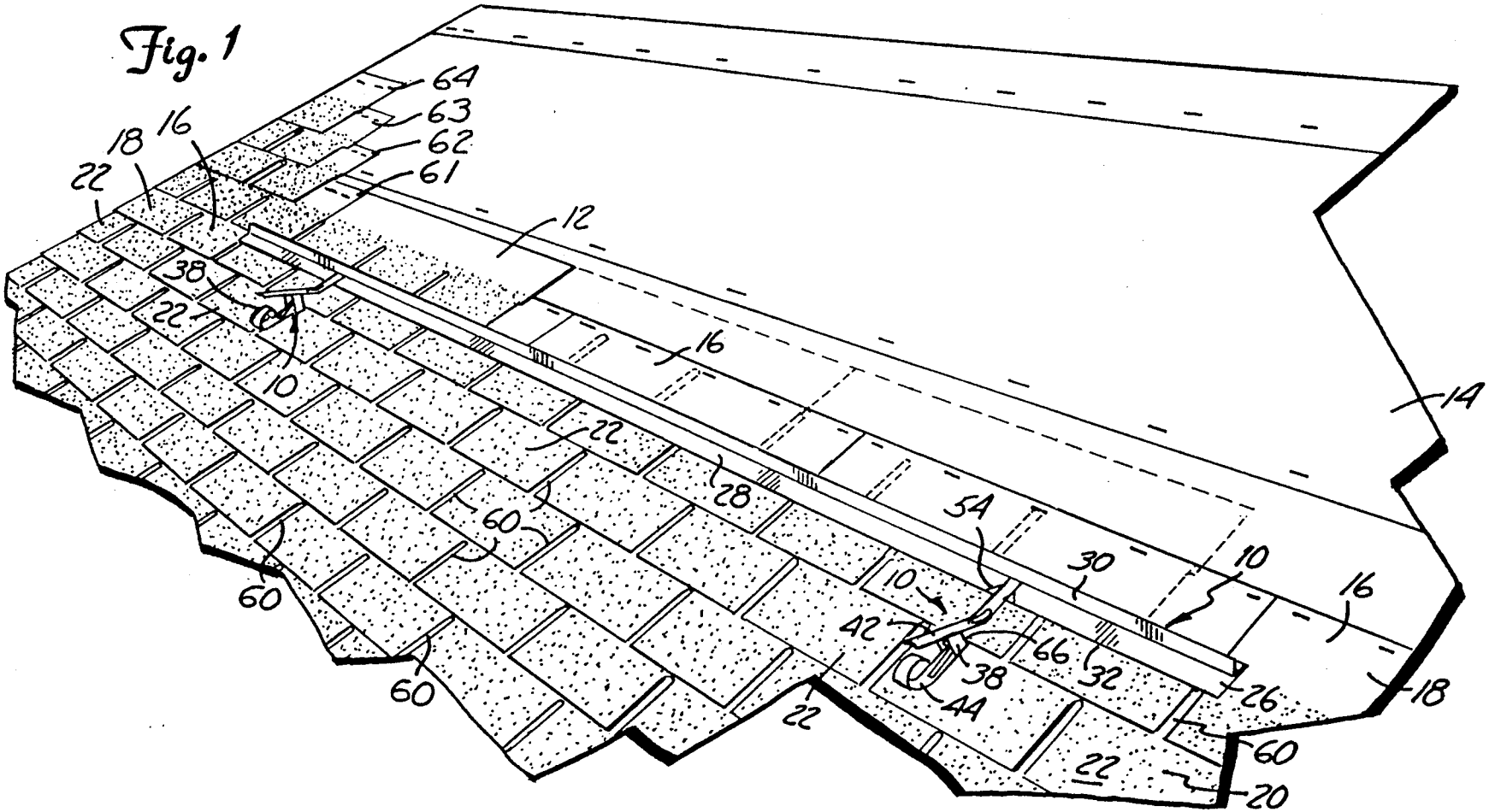
FIG. 1 is a fragmentary perspective view of a roof and a partially completed roofing project with a strip shingle alignment tool of a first embodiment of the present invention shown in its operating position.

A strip shingle alignment tool 10 of a first embodiment of the invention is for positioning unfastened strip shingles such as the shingle 12 on a roof such as roof 14 with respect to fastened strip shingles such as shingles 16 which make up a top fastened shingle strip such as the top fastened shingle strip 18. In FIGS. and 6, a next-to-the-top fastened shingle strip 20 is made up of next-to-the-top fastened strip shingles 22.

The shingle alignment tool 10 includes an elongate straight-edge upper or unfastened shingle positioning plate 26 which is made up of a substantially flat, longitudinally extending base flange 28 and a longitudinally extending upper shingle strip positioning flange 30 which extends upwardly from the base flange in normal relationship to the plane of the base flange.

The shingle positioning plate can be of any preferred longitudinal dimension. A length of ten feet has been found satisfactory; and it is this ten foot length that has been shown and described.

In the forms of the invention as shown, the upper shingle positioning plate 26 is made of one piece of sheet metal. The base flange extends from its rear edge 32 up to and including a doubled back front edge portion 34. The doubled back portion is integral with the upper shingle strip positioning flange 30 along the entire longitudinal length of the tool. This connection of the upper shingle strip positioning flange and the doubled back front edge portion 34 of the base flange 28 defines a straight upper or unfastened shingle bottom edge positioning line 36.

The alignment tool 10 also includes, in the first embodiment of the invention as shown, two spaced-apart clamps 38,38 each pivotally mounted with respect to the shingle positioning plate 26 as at 40.

Each clamp 38 includes an elongate upper jaw 42, and a lower jaw 44. The lower jaw has a pair of upwardly extending pivot legs 46,46; and the upper jaw has a pair of downwardly extending pivot legs 48,48. The jaws are pivoted with respect to each other on a pivot pin 50 extending through provided openings in legs 46, 48, 48 and 46. A resilient means for constantly urging the jaws of the clamps into the closed position seen in FIG. 2, is here shown to be a coil spring 52.

Figure 3:
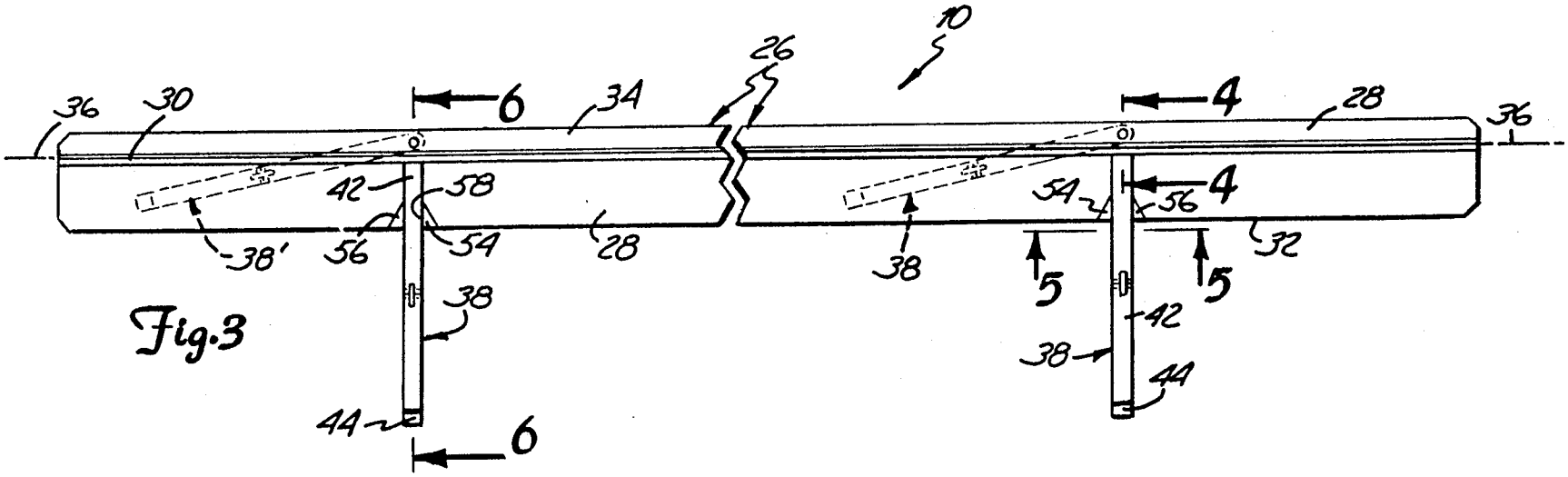
FIG. 3 is a top plan view of the tool of FIGS. 1 and 2.
Figure 6:
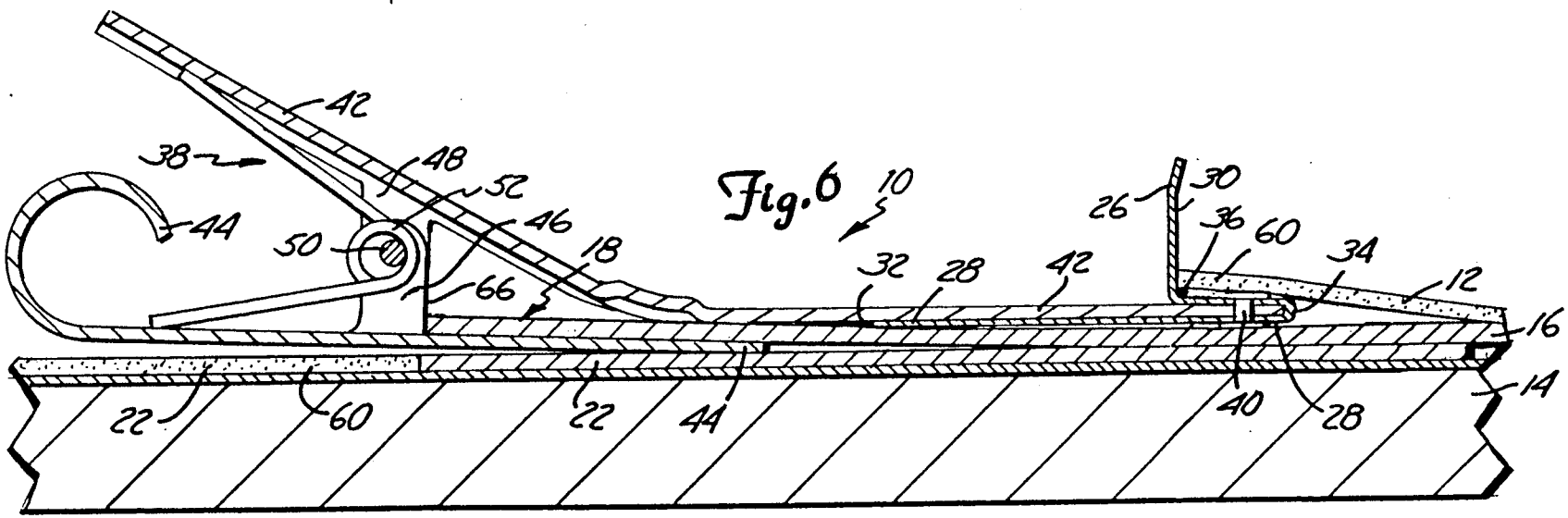
FIG. 6 is an enlarged vertical sectional view taken on the line 6—6 in FIG. 3.
Figure 8:
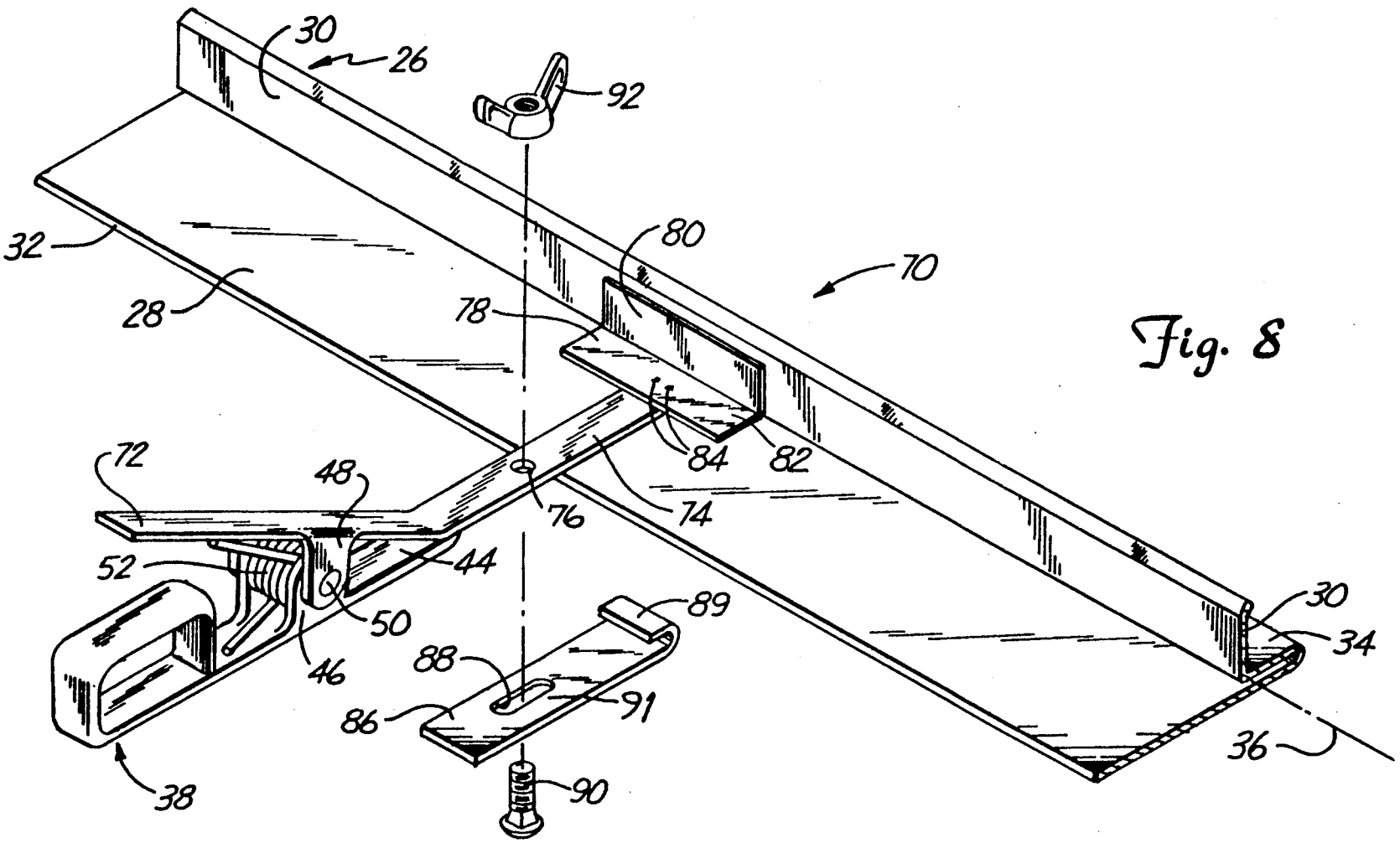
FIG. 8 is an exploded view of a portion of one of two identical clamps of the alignment tool of FIG. 7 showing its position relative to the rest of the tool.

As perhaps most clearly seen in FIGS. 2, 3 and 6, it is the upper jaw 42 of each clamp 38 which is pivotally mounted by the rivet 40 to the portion of the base flange 28 extending forwardly of the shingle positioning plate 26. This pivotal attachment of the upper jaw of each clamp 38 is valuable in that it allows each clamp to be swung about pivot point 40 until the upstanding handle of the upper jaw 42 comes into contact with the back side of the upper shingle strip positioning flange 30, a position of the clamps 38,38, which is shown in dotted lines in FIG. 3. With the entire clamp within the total width of the base flange in this storage or carrying position of the alignment tool, the tool takes much less space for packaging or storing, and is much more easily handled in transporting the alignment tool to and from the roof surface.

In order to be usable for its intended purpose, however, the clamps must be positioned and maintained so that their longitudinal axes are normal to the straight upper shingle bottom edge positioning line 36. To achieve this position and to maintain it, a pair of upper jaw movement limiting stops 54,54 are provided in opposed relation to each other, in contact with and on either side of the upper jaws 42 of each of the clamps 38,38. These jaw movement limiting stops are formed by upsetting rear edge portions of the base flange 28. As perhaps best seen in FIGS. 2 and 5, each triangular limiting stop is provided with an edge 56 integral with the remainder of the rear edge portion of the base flange 28, and an edge 58 which is in upstanding, contacting movement-preventing relationship with respect to upper jaw 42.

To bring the clamps 38 from the storage position as illustrated in dotted lines in FIG. 3 to the operating position shown in full lines in that FIGURE, the jaw handles can be used to swing each clamp from the dotted line position toward the full line position. To allow the upper jaw 42 to reach the right-hand limiting stop 54 to position its longitudinal axis in normal relation to the shingle bottom edge positioning line as seen in FIG. 3, the sheet metal base flange 28 and left limiting stop 54 will be flexible enough so that the upper jaw will pass over the left limiting stop and come to rest in contact with the right limiting stop. To move the clamps from the operating position toward the storage position, it is necessary only to manually depress one or the other of the limiting stops 54 to cause the limiting stop and/or the rear edge portion of the base flange 28 to be deflected downward enough to allow the upper jaw 42 to pass over the depressed limiting stop.

The strip shingle alignment tool 10 is most useful to allow the rapid alignment of three end fastened strip shingles at a time so that they can be rapidly nailed or stapled to the roof. As best seen in FIG. 1, the unfastened shingle 12 is shown to be, like all of the other shingles illustrated, a square three-tab strip shingle measuring three feet long across the top and including two "shadow lines" or slits 60,60 located about one foot apart to constitute each tab as one foot in width minus the dimension of the shadow lines themselves. These shingles are so made that one-half the thickness of the shadow line is cut away from each end of each shingle so that when two shingles are butted to each other, the shadow line 60 will be of the same dimension as the shadow lines in the middle of the shingle.

A strip shingle alignment tool 70 of a second embodiment of the invention is substantially the same as strip shingle alignment tool 10 of the first embodiment of the invention with the exception that upper jaw 42 of each of the two spaced-apart clamps 38 has been replaced with an upper jaw 72 in the second embodiment. Upper jaw 72 can be identical with the upper jaw 42 of the first embodiment except for that part of it which extends forwardly beyond the lower jaw 44, and except for certain additional elements which are releasably related to that forwardly extending portion.

For ease in understanding the second embodiment of the invention, all parts which are identical with the parts of the first embodiment have been identically numbered.

As illustrated and described in connection with the first embodiment, the overall length of the unfastened shingle positioning plate 26 can be ten feet. In preparing this strip shingle alignment tool for retail distribution and for mail order sales, it became evident that the clamps should be packaged and sold as a stand-alone unit without preattachment to the shingle positioning plate. Rather than expect the final user of the product to be able to successfully apply the rivet 40 of the first embodiment to mount the forward end portion of the upper jaw 42 to the base flange 28, the structure for releasably relating each of the two spaced-apart clamps 38 to the base flange was developed. A forward portion 74 of the upper jaw 72 is provided with a bolt receiving opening 76. A right angle plate 78 has an upstanding leg 80 and a lying down leg 82 situated at right angles to each other. The down leg 82 is spot welded as at 84 to the forward portion 74 of the upper jaw 72 in position so that when the upstanding leg 80 is in contact with the back face of the longitudinally extending upper shingle strip positioning flange 30, the upper jaw 72 and consequently the longitudinal axis of the strip shingle alignment tool 70 will be in normal relationship to the unfastened shingle bottom edge positioning line 36. When so positioned, the forwardmost portion of the forward portion 74 of the upper jaw can extend between legs of the doubled back front edge portion 34 of the base flange to give the clamp 38 further stability.

A J-shape bottom attachment plate 86 is provided with an elongate carriage bolt shoulder receiving slot 88. As best seen in FIG. 9, a J-shape end portion 89 of the plate 86 is configured to fit snugly over the front edge portion 34 of the base flange 28 and an integral flat portion 91 is configured to fit flat up against the underside of the base flange.

To install each of the clamps 38,38 in the second embodiment of the invention, the J-shape portion 89 of the attachment plate 86 will be placed in snugly fitting, overlying relation to the doubled back front edge portion 34 of the base flange 28. The forward portion 74 of the upper jaw 72 of clamp 38 is slid between the doubled back, spaced-apart, legs of the front edge portion 34 to bring the upstanding leg 80 of angle plate 78 into contact with the back face of the shingle positioning strip 30. The bolt receiving opening 76 in the forward portion 74 of the upper jaw 72 is aligned with the elongate slot 88 in the attachment plate 86. In the form of the invention as shown, a carriage bolt 90 is passed through the slot and the opening, and a wing nut 92 is used to firmly fix the parts in position as seen in FIGS. 7 and 9.

While in the form of the invention as shown, the bolt receiving opening has been shown to be in the upper jaw 72 and the slot in the attachment plate 86, a round or rectangular opening could be in the attachment plate and a slot the width of the bolt could be provided in the upper jaw. In fact, any means of fastening that portion of the attachment plate extending rearwardly of the rear edge 32 of the base flange to the upper jaw 72 to fix the upstanding leg of the right angle plate firmly against the shingle strip positioning flange and to fix the J-shape portion of the attachment plate firmly against the front edge portion 34 of the base flange will be effective.

OPERATION

Preparatory to utilizing either the alignment tool 10 or 70, the bottom edge of the roof will often be covered with a starter roll consisting of a single shingle strip running, where possible, the entire length of the bottom edge of the roof. This is not illustrated, but the top fastened shingle strip 18 with its fastened shingles 16 will serve to illustrate the use of the invention clearly. After the top fastened shingle strip 18 is completed by fastening all of the strip shingles 16, it is equivalent to the starter roll. Before using the alignment tool 10 or 70 on the next strip, half of a tab will be cut from a three-tab shingle to form a 2½ tab shingle 61 which will be properly aligned with the one-half tab in line with left edge of the roof. That shingle 61 will be fastened into place by nailing or stapling as desired. Another three tab shingle will be cut so that it becomes a two tab shingle 62 of yet a higher strip, and it will be properly positioned as seen in FIG. 1 with its left edge aligned with the left edge of the roof. A shingle will then be cut so that it has one and one-half tabs, and it is properly positioned with its left edge against the left edge of the roof, and it, too, is fastened down to become shingle 63. A one-tab shingle is fastened to become shingle 64.

With these "starter" shingles in place as in FIG. 1, the strip shingle alignment tool 10 or 70 can be used to its best advantage. Each full three tab shingle is three feet long, and each shadow line or slit 60 extends five inches up from the straight bottom edge of the shingle. Each shingle measures one foot from top to bottom. It is desired that the shingles be laid so that the bottom edge of each shingle just exactly reaches the top of the shadow line or slit 60 of the shingles below. It follows that perfect spacing can be obtained if the unfastened shingles are butted against the first starter shingle 61 and are positioned so that their bottom straight edges are precisely five inches above the bottom straight edges of the top fastened shingle strip 18. This is accomplished in the drawings as shown, by abutting the unfastened strip shingle 12 up against the 2½ tab shingle 61.

As shown herein, the overall length of the upper or unfastened shingle positioning plate 26 is ten feet. To utilize the alignment tool 10 or 70 in the precise positioning of the strip shingle 12 and of the next two shingles, which are shown in dotted lines in FIG. 1, the lower jaw 44 of the clamp 38 shown to the left in FIG. 1 is opened or separated from the upper jaw 42. The right-hand tab of shingle 61 is raised slightly so that the front edge portion 34 of the base flange 28 can be slid under it and the alignment tool moved toward the bottom edge of the right-hand tab of shingle 61 which is already fastened in precisely the right position. As this happens, the bottom edge of a shingle in the top fastened shingle strip 18 will come into contact with the forward edges of the upwardly extending pivot legs 46,46. These forward surfaces form a lower row positioning stop 66. In the forms of the invention as shown, and to accommodate the particular size and shapes of the shingles illustrated herein, the distance between this lower row positioning stop 66 in direction normal to the upper shingle bottom edge positioning line is precisely five inches. With the left clamp 38 and the left end portion of the shingle positioning plate 26 so positioned, those upper and lower jaws 42 and 44 will be released and will take position approximately as shown in FIG. 6. If only one roofer is working on a crew, that person will then open the lower jaw 44 of the clamp 38 to the right as seen in FIG. 1, will move that jaw up under a fastened shingle 16 of the top fastened row 18 until the lower row positioning stop encounters the bottom edge of this fastened shingle, and will then release the jaw. This positioning is then approximately as seen in FIG. 6 also.

Unfastened shingle 12 can then be butted against shingle 61, and moved down until the bottom edge of shingle 12 has position against the upper shingle strip positioning flange 30 as clearly illustrated to the right in FIG. 6. Unfastened strip shingle 12 can then be nailed or stapled into place, and two more identical square three tab shingles can be abutted against the upper shingle positioning flange 30 as seen in dotted lines in FIG. 1 and then rapidly nailed into place.

By moving each of the clamps to a slightly open position, the entire alignment tool can be removed, and moved to the right as seen in FIG. 1 where it will again be fastened using the bottom edge of other shingles in the top fastened shingle strip as guides for positioning of the upper shingle strip positioning flange 30 so that three more shingles can be rapidly and perfectly positioned and fastened. Obviously if there are at least two persons on the roofing project, the alignment tool can be moved very rapidly from one position to the next across the roof; but it is perfectly possible for one person to fasten one of the clamps 38 at a time, put the alignment tool in proper position and still achieve the same results of accurately positioned and quickly fastened shingles.

Although the present invention has been described with reference to preferred embodiments, workers skilled in the art will recognize that changes may be made in form and detail without departing from the spirit and scope of the invention.

What is claimed is:

1. A strip shingle alignment tool for positioning strip shingles on a roof with respect to strip shingles of an already fastened shingle strip, preparatory to fastening them to the roof, said fastened and unfastened shingles each being partially defined by a straight bottom edge; said tool including:

a. an elongate straight-edge unfastened shingle positioning plate having a substantially flat, longitudinally extending base flange and a longitudinally extending unfastened shingle strip positioning flange extending up from the base flange in normal relation thereto and defining at its connection with the base flange, a straight unfastened shingle bottom edge positioning line;

b. at least two spaced-apart clamps, each clamp having an upper jaw mounted to the shingle positioning plate and extending rearwardly in the plane of the base flange in normal relation to the bottom edge positioning line, each clamp having a lower jaw pivoted to the upper jaw and adapted to extend under a bottom edge portion of a shingle in the strip of fastened shingles, and each clamp being manually operable to move the jaws between open and closed positions;

c. resilient means tending to maintain the jaws in closed position;

d. a fastened-shingle bottom edge locating stop between the jaws, each stop being positioned to come into interfering relation with said bottom edge of said shingle in the fastened shingle strip when its clamp is not in closed position and said lower jaw is extended to the limit of its movement up under said shingle of the fastened strip;

e. wherein the distance between the locating stop and the bottom edge positioning line in direction normal to the positioning line is equal to a predetermined desired distance between the bottom edge of the fastened shingle strip and the bottom edge of the shingles to be fastened;

f. the mounting of the upper jaw to the shingle positioning plate is a pivotal mounting of that jaw to the base flange on an axis lying in a vertical plane, this mounting permitting the clamp to be movable between an operating position normal to the bottom edge positioning line and a storage and handling position at an acute angle with respect to said bottom edge positioning line;

g. releasable means provided to positively fix each of the clamps in its operating position;

h. wherein the base flange of the shingle positioning plate is made of sheet metal and extends rearwardly away from the bottom edge positioning line in a substantially flat plane partially defined by a base flange rear edge lying in spaced, parallel relation to the bottom edge positioning line;

i. wherein a forward end portion of each upper clamp jaw is pivoted to the base flange in forwardly spaced relation to the base flange rear edge; and j. wherein the releasable means to fix each clamp in its operating position is constituted as a pair of upper jaw movement limiting stops on a portion of said base flange rear edge, one in contact with each side of the upper clamp jaw.

2. The alignment tool of claim 1 wherein:

k. each limiting stop consists of a tab stamped up from the base flange rear edge portion, said tab extending upwardly at an acute angle from the base flange to have a first edge portion integrally connected to the base flange and a second edge portion in contacting, movement blocking relation to one side of its upper clamp jaw when said upper jaw is in its operating position; and l. said base flange and its tabs are sufficiently flexible to allow one of the tabs to be depressed sufficiently to allow the upper jaw to be moved over that tab to achieve its storage and handling position.

3. A strip shingle alignment tool for positioning strip shingles on a roof with respect to strip shingles of an already fastened shingle strip, preparatory to fastening them to the roof, said fastened and unfastened shingles each being partially defined by a straight bottom edge; said tool including:

a. an elongate straight-edge unfastened shingle positioning plate having a substantially flat, longitudinally extending base flange and a longitudinally extending unfastened shingle strip positioning flange extending up from the base flange in spaced relation to the front straight edge of the base flange, in normal relation to the base flange and defining at its connection with the base flange, a straight unfastened shingle bottom edge positioning line;

b. at least two spaced-apart clamps each clamp having an elongate upper jaw mountable to the shingle positioning plate to extend rearwardly in the plane of the base flange in normal relation to the bottom edge positioning line to support that clamp in an operating condition, each clamp having a lower jaw pivoted to the upper jaw and adapted to extend under a bottom edge portion of a shingle in the strip of fastened shingles, and each clamp being manually operable to move said jaws between open and closed positions;

c. resilient means tending to maintain the jaws in closed position;

d. a fastened-shingle bottom edge locating stop between the jaws, each stop being positioned to come into interfering relation with said bottom edge of said shingle in the fastened shingle strip when its clamp is not in closed position and said lower jaw is extended to the limit of its movement up under said shingle of the fastened strip;

e. wherein the distance between the locating stop and the bottom edge positioning line in direction normal to the positioning line is equal to a predetermined desired distance between the bottom edge of the fastened shingle strip and the bottom edge of the shingles to be fastened;

f. means provided to positively fix each of the clamps in its operating position;

g. wherein the base flange of the shingle positioning plate is made of sheet metal and extends rearwardly away from the bottom edge positioning line in a substantially flat plane partially defined by a base flange rear edge lying in spaced, parallel relation to the bottom edge positioning line;

h. wherein the means to fix each clamp in its operating position includes means operative to hold a forward end portion of each upper clamp jaw in contact with an upper surface of said base flange and releasable means to fixedly position the longitudinal axis of said upper jaw to lie in parallel relation to the plane of the base flange and in normal relation to the bottom edge positioning line; and i. wherein the means to fix each clamp in its operating position includes a pivotal connection between the forward end portion of the upper jaw and the base flange at a point space forwardly from the base flange rear edge and a releasable means to fix each clamp in its operating position constituted as a pair of upper jaw movement limiting stops on a portion of said base flange rear edge, one in contact with each side of the upper clamp jaw.

4. A strip shingle alignment tool for positioning strip shingles on a roof with respect to strip shingles of an already fastened shingle strip, preparatory to fastening them to the roof, said fastened and unfastened shingles each being partially defined by a straight bottom edge; said tool including:

a. an elongate straight-edge unfastened shingle positioning plate having a substantially flat, longitudinally extending base flange and a longitudinally extending unfastened shingle strip positioning flange extending up from the base flange in spaced relation to the front straight edge of the base flange, in normal relation to the base flange and defining at its connection with the base flange, a straight unfastened shingle bottom edge positioning line;

b. at least two spaced-apart clamps each clamp having an elongate upper jaw mountable to the shingle positioning plate to extend rearwardly in the plane of the base flange in normal relation to the bottom edge positioning line to support that clamp in an operating condition, each clamp having a lower jaw pivoted to the upper jaw and adapted to extend under a bottom edge portion of a shingle in the strip of fastened shingles, and each clamp being manually operable to move said jaws between open and closed positions;

c. resilient means tending to maintain the jaws in closed position;

d. a fastened-shingle bottom edge locating stop between the jaws, each stop being positioned to come into interfering relation with said bottom edge of said shingle in the fastened shingle strip when its clamp is not in closed position and said lower jaw is extended to the limit of its movement up under said shingle of the fastened strip;

e. wherein the distance between the locating stop and the bottom edge positioning line in direction normal to the positioning line is equal to a predetermined desired distance between the bottom edge of the fastened shingle strip and the bottom edge of the shingles to be fastened;

f. means provided to positively fix each of the clamps in its operating position;

g. wherein the base flange of the shingle positioning plate is made of sheet metal and extends rearwardly away from the bottom edge positioning line in a substantially flat plane partially defined by a base flange rear edge lying in spaced, parallel relation to the bottom edge positioning line;

h. wherein the means to fix each clamp in its operating position includes means operative to hold a forward end portion of each upper clamp jaw in contact with an upper surface of said base flange and releasable means to fixedly position the longitudinal axis of said upper jaw to lie in parallel relation to the plane of the base flange and in normal relation to the bottom edge positioning line; and i. wherein the means to fix each clamp in its operating position includes:

(1) a right angle plate having an upstanding leg and a horizontal leg, the horizontal leg being permanently mounted to an upper surface of the forward end portion of the clamp upper jaw to position a laterally extending forward face of the upstanding leg to lie in normal relation to the longitudinal axis of the upper jaw, (2) a J-shape bottom attachment plate having a J-shape end portion configured to fit over the base flange front edge portion forward of the shingle strip positioning flange and having a flat portion configured to lie flat against the underside of the base flange and to extend rearwardly beyond it, and (3) releasable means to fasten the flat portion of the attachment plate to the clamp upper jaw in position to hold the forward face in firm contact with the shingle strip positioning flange by holding the J-shape portion of the attachment plate firmly against the front edge portion of the base flange.

5. The alignment tool of claim 4 wherein:

j. the releasable means includes openings provided in the upper jaw and in the attachment plate positioned to be mutually aligned rearwardly from the base flange rear edge, and fastening means extending through said openings to fixedly position the upper jaw and attachment plate with respect to each other.

* * * * *